United States Patent [19]

Goedken et al.

[11] Patent Number: 4,605,126

[45] Date of Patent: Aug. 12, 1986

[54] PALLET AND TANK ASSEMBLY

[75] Inventors: James H. Goedken; David L. Waltke, both of Beatrice, Nebr.

[73] Assignee: Hoover Universal, Inc., Ann Arbor, Mich.

[21] Appl. No.: 656,575

[22] Filed: Oct. 1, 1984

[51] Int. Cl.[4] ..... B65D 19/00

[52] U.S. Cl. ..... 206/386; 206/446; 206/486; 220/1 B; 220/85 S

[58] Field of Search ..... 206/386, 446, 486; 220/1 B, 3, 85 S, 86 R, 85 SP

[56] References Cited

U.S. PATENT DOCUMENTS

| | | | |
|---|---|---|---|
| 61,148 | 1/1867 | Bizard et al. | 220/1 B |
| 1,432,619 | 10/1922 | Racine | 220/1 B |
| 3,306,439 | 2/1967 | Storey | 206/486 |
| 3,747,780 | 7/1973 | Schneider | 206/446 |
| 4,324,333 | 4/1982 | Porter | 206/386 |
| 4,349,109 | 9/1982 | Scordato et al. | 206/486 |
| 4,361,232 | 11/1982 | Olmsted | 206/386 |
| 4,406,366 | 9/1983 | Forshee | 206/386 |

*Primary Examiner*—Joseph Man-Fu Moy

*Attorney, Agent, or Firm*—Stephenson and Boller

[57] ABSTRACT

A multiple tank and pallet assembly comprising a rectangular pallet and four rectangular tanks arranged in a side-by-side confined cluster on the pallet enabling handling and transport of the pallet and tanks as a unit, individual tanks being removable from the assembly when desired. Each of the tanks is particularly constructed to facilitate discharge of the contents so that the assembly can be used to dispense four different liquids.

1 Claim, 4 Drawing Figures

PALLET AND TANK ASSEMBLY

BACKGROUND OF THE INVENTION

This invention relates generally to the field of tanks for use in storing and transporting liquid materials, and more particularly to tanks for use in supplying several different liquids to a single location in a single package. Past practices have involved such inefficiencies as the handling of small size containers which are delivered in a full condition and picked up in an empty condition.

It is an object of the present invention to provide an improved pallet and tank assembly which includes a plurality of tanks to enable the delivery of a plurality of different liquids while retaining the efficiency of a single unit handling of the four tanks on a common pallet. The tanks can be removed from the pallet for washing and repair, and the tanks can be made of the requisite stainless steel material for cleanliness purposes without requiring the construction of the pallet of this same expensive material.

In addition, the individual tanks in the assembly of this invention are constructed with formed sumps in their bottom walls to enable total exhaust of the tank contents and preventing the tanks from standing alone so that the tanks have no utility apart from the assembly of this invention. This construction works to prevent theft of the tanks.

SUMMARY OF THE INVENTION

This invention consists of a multiple tank and pallet assembly comprising a rectangular pallet having upstanding side and end walls and a bottom wall and a plurality of rectangular tanks arranged side-by-side in wall-to-wall engagement so as to fit snugly within the side and end walls of the pallet in a supported position on the pallet bottom wall. This enables handling of the pallet and tank assembly as a single unit by conventional fork-lift trucks and the like while still enabling removal of the individual tanks for cleaning and repair, when desired. Each tanks has a cover on which is mounted an air fitting to enable pressurizing of the tank contents and a discharge conduit which extends upwardly from an internal sump in the tank bottom wall to a supported position on the cover to facilitate removal of the tank contents. The sumps in the tanks extend downwardly through openings in the bottom wall of the pallet so that the flat bottom walls of the tanks will be supported on the flat bottom wall of the pallet.

Further objects, features and advantages of this invention will become apparent from a consideration of the following description, the appended claims, and the accompanying drawing in which:

Figure 1:
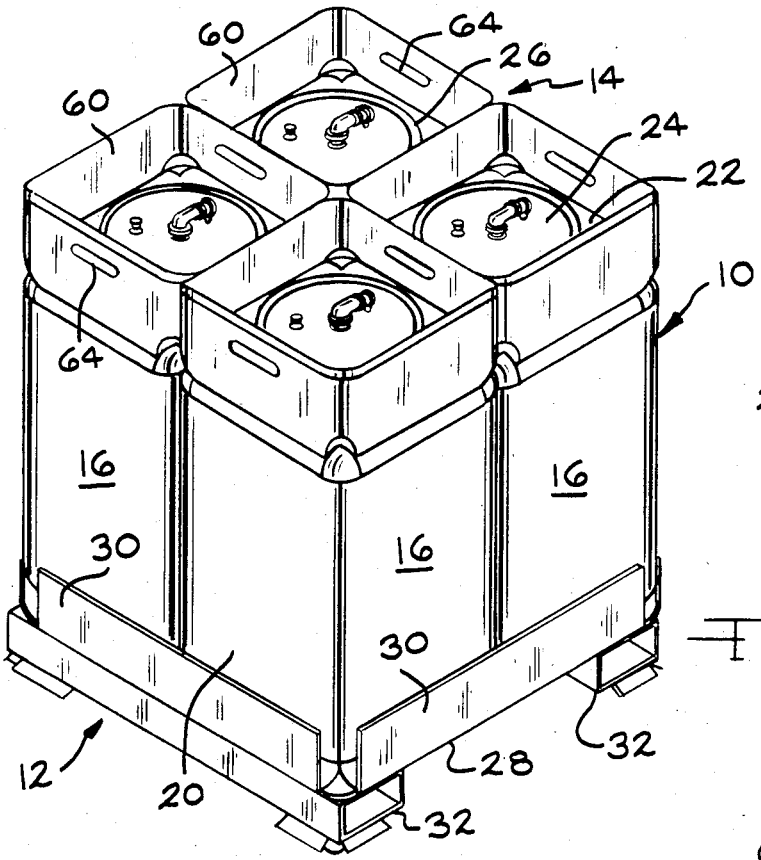
FIG. 1 is a perspective view of the assembly of this invention.

With reference to the drawing, the pallet and tank assembly of this invention, indicated generally at 10, is shown in FIG. 1 as including a rectangular pallet 12 and a rectangular cluster 14 of rectangular tanks 16. In a preferred embodiment of the invention, the cluster 14 consists of four tanks 16, each of which includes a rectangular bottom wall 18, upright side walls 20, and a top wall 22 which includes a removable cover 24. In the illustrated embodiment of the invention, the cover 24 is circular in shape and is removably retained on the top wall 22 by a releasable mounting ring 26.

The pallet 12 has a rectangular bottom wall 28 provided on its top side with short upstanding side and end walls 30 which function as retaining flanges for maintaining the tank cluster 14 in a supported position on the pallet bottom wall 28. On its bottom side, the pallet bottom wall 28 has downwardly extending spaced apart leg assemblies 32 which are floor supportable to position the pallet bottom wall 28 at a position above the floor so that the tines on conventional fork lift trucks and the like can be inserted under the pallet bottom wall 28 to lift the assembly 10.

Figure 4:
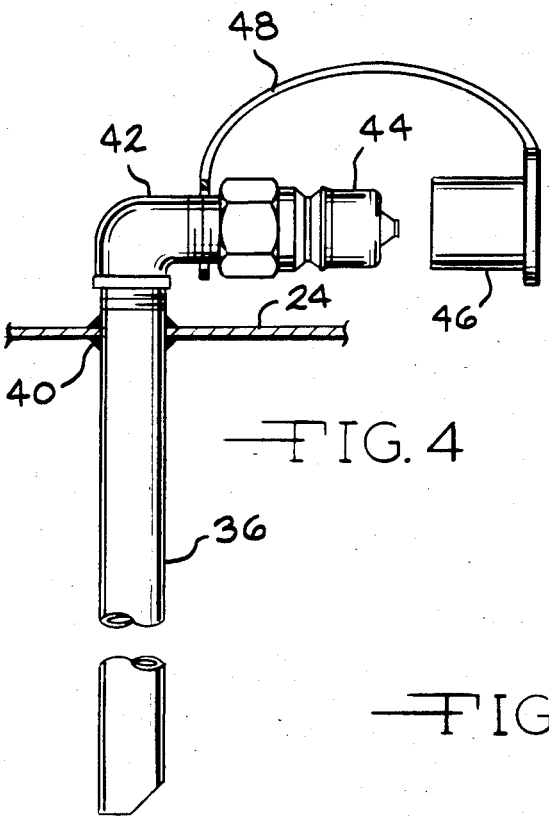
Figure 2:
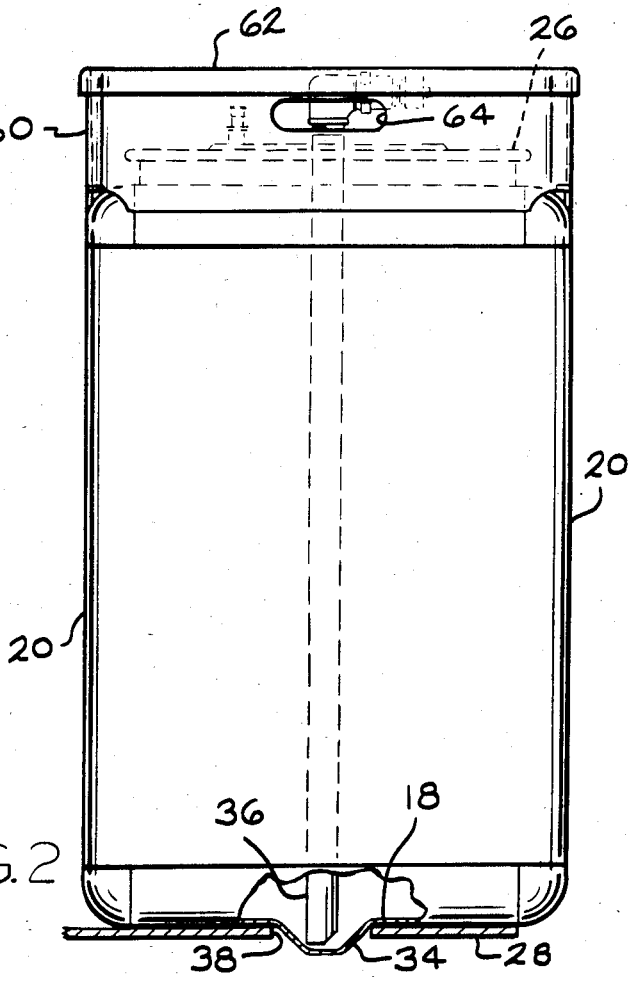
FIG. 2 is a side view of a tank in the assembly of this invention, with some parts broken away and other parts shown in section for the purpose of clarity.

As shown in FIGS. 2 and 4, the bottom wall 18 of each of the tanks 16 is provided with a downwardly extending formed sump 34 and an upright discharge tube 36 in the tank 16 extends downwardly to a position within the sump 34 to enable complete discharge of the tank contents. The sump 34 is preferably circular in horizontal cross section and extends downwardly within a circular opening 38 in the pallet bottom wall 28. The pallet bottom wall 28 is flat and the bottom wall 18 of the tank 16 surrounding the formed sump 34 is also flat so that the tank 16 can be positioned in a firmly supported location on the pallet 12.

The upper end of the discharge conduit 36 is secured to the tank cover 24, preferably by welding 40, as shown in FIG. 4. In the illustrated form of the invention, an elbow fitting 42 is secured to the upper end of the discharge conduit 36 and a normally closed valve 44 is mounted on the fitting 42. A protective cover 46, retained on the fitting 42 by a flexible strap 48, is telescoped over the valve 44 during transport of the assembly 10 for protecting the valve 44. When it is desired to discharge the contents of a tank 16, the cover 46 is removed from the valve 44, and a conventional discharge hose or line (not shown) is telescoped over the valve 44 to open the valve and draw out the contents of the tank 16.

Figure 3:
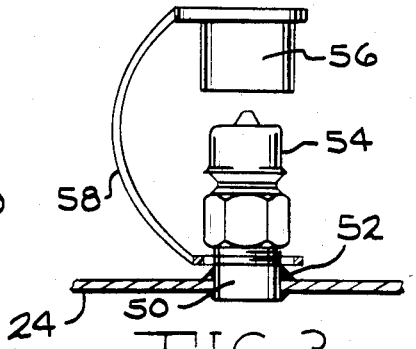
FIGS. 3 and 4 are enlarged views of the air inlet fitting and discharge conduit portions of each of the tanks in the assembly of this invention.

The tank 16 is preferably pressurized to assist in discharge and for this purpose, a fitting 50 is secured, as by welding 52, to the cover 24 as shown in FIG. 3. The fitting 50 includes a valve 54 to which a conventional air hose can be attached to open the valve and direct air under pressure through the fitting 50 into the tank 16 for pressurizing the contents and forcing the contents out of the tank through the conduit 36. A protective cover 56, mounted on the fitting 50 by a retaining strap 58 can be telescoped over the valve 54 when the tank is being used to transport the contents.

The tanks 16 are of rectangular shape in cross section and are of a size such that when they are arranged in the rectangular cluster 14 shown in FIG. 1, they will occupy a rectangular space of the size defined by the retaining flanges 30 on the pallet 12. Accordingly, when the tanks 16 are positioned as shown in FIG. 1, they are in sidewall-to-sidewall engagement and are engaged with the inner surfaces of the retaining flanges 30 so that the tanks 16 will not slide on the top surface of the pallet bottom wall 28. This enables handling of the assembly 10 as a unit when the assembly 10 is being used to fill the tanks 16, discharge the tanks 16, or transport the tanks 16. When cleaning or repair of a tank 16 is required, however, the tank 16 is readily removed from the assembly 10 by virtue of the upright rectangular stacking wall 60 which is formed on each tank. The wall 60 constitutes an upward extension of the tank side walls 20; the upper end 62 of the wall 60 being above the fittings 42 and 50, as shown in FIG. 2. The walls 60 enable stacking of the tanks 16 and also protect the fittings 42 and 50. In addition, each of the walls 60 is provided with diametrically opposed lift openings 64 which facilitate lifting of a tank 16 upwardly off the pallet 12.

From the above description, it is seen that this invention provides an improved pallet and tank assembly 10 which faciliates the transport and dispensing of a variety of liquids from an assembly 10 which can be handled as a unit.

What is claimed is:

1. A multiple tank and pallet assembly comprising a rectangular pallet having short upstanding side and end walls and a bottom wall, a rectangular cluster of rectangular tanks supported on said pallet bottom wall within the boundaries defined by said side and end walls, each of said tanks having upright rigid side walls extending upwardly a substantial distance above said pallet side and end walls and two of which are engaged by a pair of said pallet side and end walls, said assembly being adaptable for handling as a unit and said tanks being individually removable from said assembly for individual handling, at least one of said tanks in said cluster including a top wall, a bottom wall that includes a downwardly extending formed sump, and a discharge conduit extending downwardly from the top wall into said sump, said pallet bottom wall including an opening through which said formed sump extends to enable said tank bottom wall to rest on said pallet bottom wall, said tank bottom wall around said formed sump being flat and said pallet bottom wall being flat.

* * * * *